US006321700B1

(12) United States Patent
Hein et al.

(10) Patent No.: US 6,321,700 B1
(45) Date of Patent: Nov. 27, 2001

(54) ELECTROMAGNETICALLY ACTUATABLE ADJUSTMENT DEVICE AND METHOD OF OPERATION

(75) Inventors: Nils Hein, Suhr; Peter Hille, Darmstadt; Thomas Ganser, Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/508,423

(22) PCT Filed: Sep. 7, 1998

(86) PCT No.: PCT/EP98/05670

§ 371 Date: Mar. 13, 2000

§ 102(e) Date: Mar. 13, 2000

(87) PCT Pub. No.: WO99/13202

PCT Pub. Date: Mar. 18, 1999

(30) Foreign Application Priority Data

Sep. 11, 1997 (DE) ..... 197 39 840

(51) Int. Cl.[7] ..... F01L 9/04

(52) U.S. Cl. ..... 123/90.11

(58) Field of Search ..... 123/90.11; 251/129.01, 251/129.1, 129.05; 335/256, 266, 269

(56) References Cited

U.S. PATENT DOCUMENTS

| | | | | |
|---|---|---|---|---|
| 5,636,601 | * | 6/1997 | Moriya et al. | 123/90.11 |
| 5,765,514 | * | 6/1998 | Sono et al. | 123/90.11 |
| 5,775,278 | * | 7/1998 | Moriya et al. | 123/90.11 |
| 5,797,360 | * | 8/1998 | Pischinger et al. | 123/90.11 |
| 5,799,630 | * | 9/1998 | Moriya et al. | 123/90.11 |
| 6,003,481 | * | 12/1999 | Pschinger et al. | 123/90.11 |
| 6,044,814 | * | 4/2000 | Fuwa | 123/90.11 |

* cited by examiner

*Primary Examiner*—John A. Jeffery
*Assistant Examiner*—Vinod D. Patel
(74) *Attorney, Agent, or Firm*—Venable; Norman N. Kunitz

(57) ABSTRACT

A method for operating an electromagnetically actuatable adjustment member, in particular a periodically operated valve for an internal combustion engines, as well as a/an apparatus for carrying out the method, wherein a path or position sensor is provided to measure the position of the adjustment member, and the current flow through the electromagnets of the device is adjusted such that the adjustment member moves along a predetermined position/speed characteristic curve.

17 Claims, 3 Drawing Sheets

ELECTROMAGNETICALLY ACTUATABLE ADJUSTMENT DEVICE AND METHOD OF OPERATION

The invention relates to a method for controlling an electromagnetically actuatable adjustment device, in particular a periodically operating gas-reversing valve for internal combustion engines, as well as an adjustment device for realizing this method according to the preamble to the independent claims.

Electromagnetically actuatable adjustment devices, in particular adjustment devices for actuating gas-reversing valves on internal combustion engines are known from literature. A control method for such an adjustment drive is disclosed in the U.S. Pat. No. 5,636,601. The adjustment device comprises a tappet, which acts upon the adjustment member and is connected to an armature that is guided axially movable between the pole surfaces of two axially spaced apart electromagnets. Two adjustment springs that are effective in opposite directions hold the armature in an intermediate position, approximately in the center between the pole surfaces for the electromagnets, if no current is supplied to the electromagnets. The control is intended to adapt the adjustment device operation to various operating conditions.

The European Patent 0 77 038 A2, upon which this invention is based, discloses a method for operating an adjustment device by using a position sensor to determine the valve position. The start-up and shutdown periods for the closing and/or opening magnets are derived from different operating parameters, such as the adjustment angle for the crankshaft, the position of the drive pedal or the air-fuel-ratio. The position sensor records the valve position to avoid possible collisions with the piston.

Not solved, however, is the problem of eliminating the influence of variables that interfere with the control and are caused by the operation, in particular temperature fluctuations, changes in the viscosity of the oil for the gas-reversing valves, wear and tear on the adjustment device or soiling of the adjustment device. This can lead to a malfunction of the adjustment device, particularly to increased wear on the adjustment device, undesirable noise development and excess energy consumption. A reliable, continuous operation of the adjustment device cannot be ensured with this.

It is the object of the invention to specify a method for controlling an adjustment device, as well as a device for realizing said method, which can ensure a safe, continuous operation of the adjustment device and a reduction in the wear and tear of the adjustment device.

The above object generally is achieved according to the present invention by a method for operating an electromagnetically actuatable adjustment member, in particular a periodically operated valve for an internal combustion engines, including a connecting rod with at least one armature that is attached crosswise to its longitudinal axis, with the armature being moved between opposing pole surfaces of two electromagnets arranged at a distance from each other in an axial direction, two resetting springs that are effective in the axial direction connected to the connecting rod so that the armature is held in a center position between the electromagnets while the electromagnets are not supplied with current, wherein the method comprises: detecting the position of the adjustment member and/or the armature using a path sensor; and adjusting the current flow through the electromagnets such that the armature and/or the adjustment member move along a predetermined position/speed characteristic curve.

The position of the adjustment member and/or the armature is preferably detected by means of a path sensor and/or the speed of the adjustment member and/or the armature is determined from this position. The position and/or the speed are then transmitted to a regulating and control unit, which processes the signals into an actuation signal for the electromagnets, by taking into account the actual adjustment variables for the adjustment device, made available by a data source. The actuation signal influences the current flow through the electromagnets.

Especially preferred is the determination of position and/or speed by determining the inductance and/or the changes in the inductance of a coil, which is used as path sensor element. It is preferable if the coil is a component of an oscillating circuit, the frequency of which serves as measure for the inductance of the coil. The frequency advantageously is a measure for the position of the armature and/or the adjustment member. In particular, the frequency change represents as measure for the speed of the armature and/or the adjustment device.

It is favorable that the current flow through the electromagnets is adjusted with the method according to the invention, such that the armature and/or the adjustment member move securely along a predetermined position/speed characteristic curve. In particular, the current flow through the electromagnets is adjusted such that the speed at which the armature comes to rest on the pole surface is less than 3 m/s.

It is useful to select the coil shape such that the position/frequency connection is at least approximately linear. One preferred form of the coil is helical while another preferred form is cylindrical.

An electromagnetically actuatable adjustment device comprises an adjustment member, in particular a periodically operated gas-reversing valve for internal combustion engines, as well as a connecting rod that is connected force-locking with adjustment member. This connecting rod comprises an armature that is attached crosswise to its longitudinal axis and can be moved between opposite-arranged pole surfaces of two electromagnets in a magnet unit, which are arranged at an axial distance to each other. The adjustment device has two resetting springs that are effective in axial direction, so that the armature assumes a center position between the two electromagnets in the currentless state. According to the invention, the adjustment device is connected at least indirectly to a path sensor element, which determines the actual position of the armature and/or the adjustment member.

The position is preferably used to determine the speed of the adjustment member and/or the armature by means of a path sensor. Preferably, the path sensor is assigned to the connecting rod for the adjustment device or is connected to it and/or forms a component of this connecting rod.

The path sensor element of one preferred embodiment is arranged on the connecting rod end that is far from the adjustment member. In another preferred embodiment, the path sensor element is arranged directly adjacent to the magnet unit. The path sensor element of yet another preferred embodiment is arranged inside an electromagnet region that essentially does not contain a magnetic field, in particular inside the region closest to the connecting rod. Particularly preferred is an arrangement of the path sensor element between the pole surfaces of the electromagnets.

The path sensor for one preferred embodiment is a semiconductor sensor, particularly a Hall sensor. In another preferred embodiment, the path sensor is a magnetic sensor and for yet another preferred embodiment, it is an optical sensor. The path sensor of a further preferred embodiment is a capacitive sensor.

It is particularly preferable if the path sensor element comprises a coil, the inductance of which can be changed at least indirectly by the connecting rod. The path sensor of a particularly preferred embodiment is formed by a coil, into which the connecting rod of the adjustment device can plunge, at least at times. It is advantageous if the connecting rod is designed such that the coil inductance is influenced by the connecting rod.

The connecting rod end that is far from the adjustment member is advantageously provided with a metallic and/or magnetic material and/or a ferrite material.

It is particularly favorable that the actual contact position of the armature and/or the point in time at which the armature makes contact can furthermore be determined precisely by means of the path sensor.

The adjustment device can be connected to a control and regulating unit, which is designed to process signals from the path sensor element and operating parameters for a machine that is connected to the adjustment device.

The features, insofar as they are essential to the invention, are explained in further detail in the following with the aid of Figures.

DETAILED DESCRIPTION OF THE PREFERRED EMBODIMENTS

The speed at which the armature makes contact with the pole surfaces of the respective electromagnet is decisive for a secure continued operation and the function of an adjustment device, for which an armature connected to the adjustment member moves between the pole surfaces of two opposite-arranged electromagnets. For this, the armature is arranged in particular on a connecting rod that is connected force-locking with the adjustment member.

If the contact speed for the armature is too high, the armature rebounds from the pole surface and cannot be held by the electromagnet. In that case, a gas-reversing valve cannot close and/or open. The force of impact of the armature at the same time leads to a higher wear of the adjustment member of the adjustment device. If the contact speed is high, but still low enough to hold the armature with magnetic attraction and counter to the spring force against the pole surface, the large pulse from the armature at the point of impact also results in increased wear and material fatigue in the adjustment member and the armature.

If the armature contact speed is too low in front of the pole surface, the armature reverses its movement direction without touching the pole surface because it is pulled back by the adjustment springs to a center position between the pole surfaces. The magnetic field of the electromagnet is too weak in that case to overcome the spring force of the resetting springs.

It is desirable to achieve the lowest possible contact speed for the armature. In the ideal case, the aim is to achieve a speed of 0 m/s for the contact between armature and pole surface. Preferably, the speed should be less than 3 m/s when making contact with a pole surface. With this, a possibly existing gas-reversing valve can open and close securely. In addition, the material for the adjustment device is protected against increased wear, an undesirable noise development is avoided during the movement of the armature and/or the adjustment member, and the energy consumption is also reduced advantageously.

According to the invention, the adjustment device is connected at least indirectly with a path sensor for determining the position and/or the speed of the armature. If the armature position is known, the adjustment member position is preferably known at the same time. A control and regulating unit picks up these signals from the path sensor and controls the current flow through the electromagnets, such that the contact speed at the contact point does not reach a predetermined limit.

The adjustment device is shown with the example of a gas-reversing valve, in particular for an internal combustion engine. However, the invention is not limited to this application. In particular, the method according to the invention is suitable for adjustment devices that can be operated by means of electromagnets.

Figure 1:
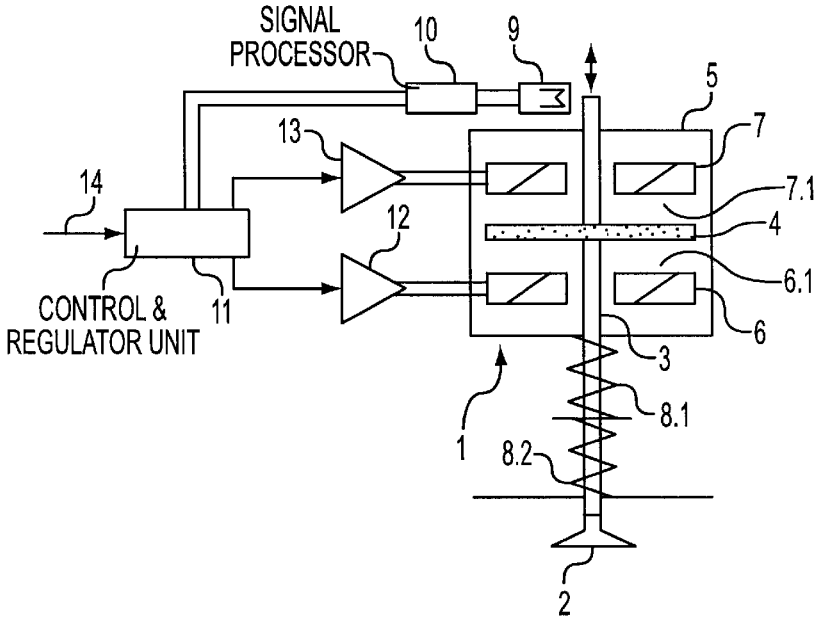
FIG. 1 shows an adjustment device according to the invention.

FIG. 1 shows an arrangement according to the invention. The adjustment device 1 consists of an adjustment member 2, in particular a valve, with a connecting rod 3 and an armature 4 that is arranged crosswise to the connecting rod. The connecting rod 3 is connected force-locking with the adjustment member or valve 2. The connecting rod 3 projects into a magnet unit 5. Two electromagnets 6 and 7 with opposite-arranged pole surfaces 6.1 and 7.1 are located inside the magnet unit 5, such that they are arranged in an axial direction relative to the connecting rod 3. The armature 4 can be moved in the axial direction between the lower and the upper electromagnets 6 and 7. Two resetting springs 8.1 and 8.2, which are effective in opposite directions, are arranged between the valve 2 and the magnet unit 5 and surround the lower region of the connecting rod 3 of adjustment device 1. These resetting springs cause the armature 4 to remain approximately in a center position between the pole surfaces 6.1 and 7.1 if the electromagnets 6 and 7 are not supplied with current. The springs can also be arranged on both sides of the armature 4, within the magnet unit 5. The armature 4 is attracted alternately by one of the pole surfaces 6.1 or 7.1 of the respective electromagnets 6, 7 under current in that electric current flows alternately through these electromagnets 6, 7. The armature moves back and forth periodically and thus moves the adjustment member 2.

If the electromagnet 7 is activated, the armature 4 comes to rest against its pole surface 7.1, wherein the spring element 8.2 is compressed and the spring element 8.1 is essentially relaxed. The valve 2 is opened in that position. In order to close the valve 2, the electromagnet 7 is turned off and the electromagnet 6 is activated. The armature 4 is no longer held against the pole surface 7.1, but is pulled by the spring force of spring element 8.2 and the force of attraction of electromagnet 6 in the direction of the pole surface 6.1. In the process, the armature/spring system moves past the center position to the pole surface 6.1 and is held there against the pole surface 6.1 by the electromagnet 6 under current. In that position, the spring element 8.1 is compressed and the spring element 8.2 is essentially relaxed. The valve 2 is closed.

A path sensor element 9 is arranged in the upper region of the connecting rod 3 for the adjustment device 1. The path sensor element 9 comprises one path sensor or several path sensors. The path sensors can be identical or have different designs. In the following, only one path sensor 9 is described. The path sensor 9 preferably records the position of connecting rod 3 and thus at the same time the position of armature 4 and adjustment member 2.

The position signal from path sensor 9 is preferably processed in a unit 10. In particular, a speed signal v is determined from the position signals s and is subsequently input into a control and regulating unit I1. It is also possible to process the sensor signals directly in the control and regulating unit 11. A separate processing unit 10 is not required for this embodiment.

The speed of armature 4 can be determined easily from the sensor signal by determining the position of armature 4, preferably with time accuracy and in particular at short time intervals, as compared to the total time required by the armature to travel from one pole surface to the other pole surface 6.1, 7.1. The path traveled by the armature 4 and/or the adjustment member 2, in particular, is also determined in this way. A time difference of a few tenths or hundredths of milliseconds is useful between the measuring points.

The evaluation and/or further processing of the position signal for adjustment device 1 occurs in the control and regulating unit 11 and leads to a targeted influencing of the final stages 12 and 13 of the two electromagnets 6 and 7. It is advantageous if the control and regulating unit is additionally connected via a line 14 to a central control unit for the arrangement, in particular the internal combustion engine, which is equipped with the adjustment device 1. The central control unit is not shown separately.

Such a possibly existing control unit can comprise adjustment variables, in particular operating parameters such as opening and/or closing angles, opening and/or closing times, speed and/or the load for an internal combustion engine, the temperature values for coolants and lubricants and/or the temperature values for semiconductor circuits. These adjustment variables are advantageously made available to the control and regulating unit 11 and, together with the position value and/or the speed derived thereof for the adjustment device 1, are processed into an actuation signal for the electromagnets 6, 7 of the adjustment device 1. The actuation signal is structured such that the speed at which the armature 4 makes contact with the pole surfaces 6.1 and 7.1 is at a minimum, preferably less than 3 m/s.

The path sensor 9 is preferably calibrated with the control and regulating unit 11 while the armature 4 is in the end positions, meaning in the positions where the armature 4 makes contact with the respective pole surfaces 6.1 and 7.1 and/or in the idle position of armature 4.

The path sensor 9 preferably is a semiconductor sensor, in particular a Hall sensor, a magnetic sensor, an optical sensor or a capacitive sensor. Favored are all types of path sensors that preferably permit a clocking frequency in the range of tenths to hundredths of milliseconds for reading the position of armature 4.

The path sensor 9 of one particularly preferred embodiment is a coil, into which the connecting rod 3 of adjustment device 1 can be plunged, at least in part. It is useful if the connecting rod 3 is designed such that it allows for a change in the inductance of the coil. The coil inductance is preferably measured with a frequency measurement, in particular in an oscillating circuit. The measured frequency is a measure for the position and the frequency change is a measure for the speed of armature 4.

The structural design of coil 9 is preferably selected such that the connection between the path traveled by the armature 4 and the frequency of the oscillating circuit containing the coil 9 is as linear as possible or is at least approximately linear. As a result, the evaluation of the position signals and the regulation and/or control are rendered particularly easy and reliable. Owing to the fact that the speed of armature 4 can also be determined from the position, the connection between speed and frequency change is thus also at least approximately linear.

It is advantageous if the moving parts of the adjustment device 1, in particular the connecting rod 3, are made of materials that can change the inductance of coil 9 at least in the regions that can be detected by the measuring coil. The regions which can be detected by measuring coil 9 are preferably electrically conducting and in particular metallic. It is preferable if the connecting rod 3 itself is made of metal, at least in some sections.

The measuring coil 9 is advantageously operated with an alternating current of sufficiently high frequency, in particular $\geqq 1$ MHZ, so that the inductance of measuring coil 9 is detected, which decreases with increasing eddy currents in the connecting rod 3.

Particularly advantageous is a method, for which the inductance of coil 9 is determined by integrating the inductance into an oscillating circuit where it forms an oscillator together with the capacity and a standard, active damping reduction, the oscillating frequency of which can be detected with a phase control loop. Preferably, this is contained in element 10. The phase control loop preferably contains a voltagecontrolled oscillator, having a control voltage that functions as output signal. The voltage for the output signal of the frequency measurement in 10 is a measure for the position of armature 4 in the adjustment device 1.

Figure 2:
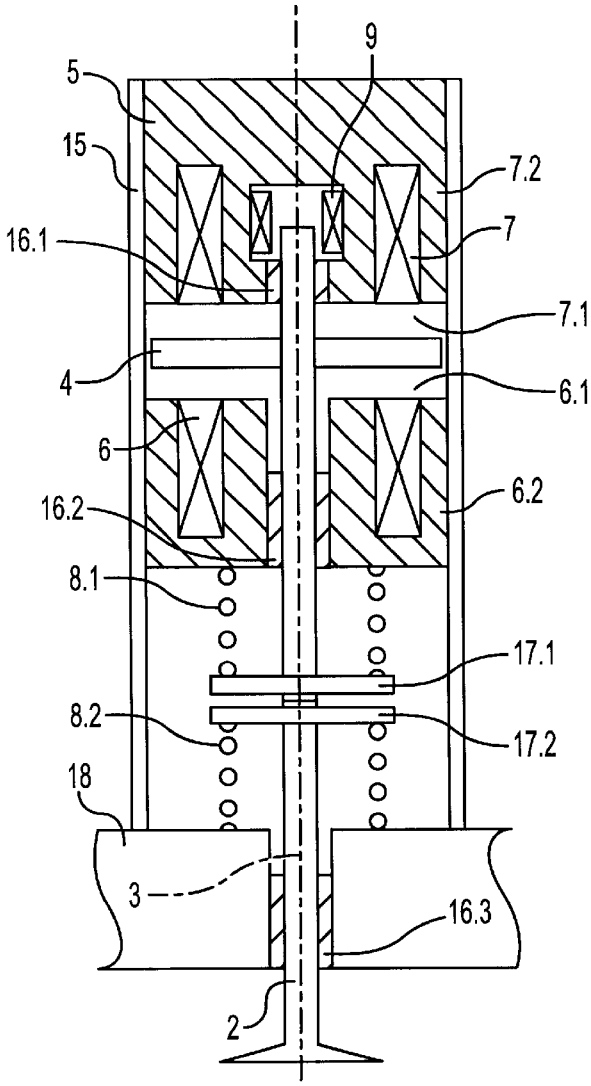
FIG. 2 shows an arrangement according to the invention with a path sensor.

FIG. 2 shows a section through a particularly preferred arrangement according to the invention of an adjustment device with a path sensor 9. The adjustment member 2 shown herein is a gas-reversing valve for an internal combustion engine. The measuring coil 9 is arranged in the yoke 7.2 of the upper electromagnet 7. In that position, it remains essentially unaffected by any current that may flow through the electromagnet 7, thereby permitting a mostly undisturbed measurement of the inductance changes in coil 9, caused by the fact that connecting rod 3 periodically plunges into the coil 9. The connecting rod end is preferably made of metal. The connecting rod end of another preferred embodiment is provided with a magnetic material. The connecting rod end of yet another preferred embodiment contains ferrite. In particular, the connecting rod 3 itself can consist of a material that can change the inductance of coil 9. The connecting rod 3 for another preferred embodiment is provided with means for influencing the inductance of coil 9.

One favorable embodiment provides for an adjustment member 2 made of ceramic and a connecting rod 3 made of a different material.

A sleeve 15 surrounds the magnet unit 5. The electromagnets 6, 7 consist of the pole surfaces 6.1, 7.1, the coils 6.3 7.3 and the associated yokes 6.2 and 7.2. The connecting rod 3 of adjustment device 1 is positioned with sliding bearings 16.1, 16.2 in the electromagnets 7 and 6 and the valve 2 is positioned with one sliding bearing 16.3 inside the cylinder head 18. The sleeve 15 is connected to cylinder head 18.

The resetting springs 8.1 and 8.2 are arranged inside the sleeve 15 and below the magnet unit 5, around the connecting rod 3, and are supported on plate-shaped projections 17.1 and 17.2 between the two springs 8.1 and 8.2. The projection 17.1 is connected to the connecting rod 3 while the projection 17.2 is connected to the cylinder head 18.

The advantage of this arrangement is that the inductance-changing effect of the end of connecting rod 3, relative to the coil 9, can be detected particularly easily by the measuring coil 9 and that the complete arrangement is compact and not sensitive to disruptions. The installation location for the path sensor 9 is also suitable for other types of sensors, in particular for semiconductor sensors.

Owing to the inertia of the electromagnetic adjustment device 1, in particular owing to the inductance of electromagnets 6, 7, it is not sufficient to use exclusively one controller for operating the adjustment device 1. According to the invention, a control with added-on regulation is therefore used to operate the adjustment device 1. The movement of adjustment device 1 is constantly balanced by automatically adjusting it to the desired characteristics curves and is not left to its internal dynamics. As a result, it is achieved that smaller deviations from the desired values, resulting from malfunction variables that occur during the operation of adjustment device 1, can be balanced securely with this automatic regulation. The regulating speed is sufficiently fast since only small deviations must be compensated.

Figure 3:
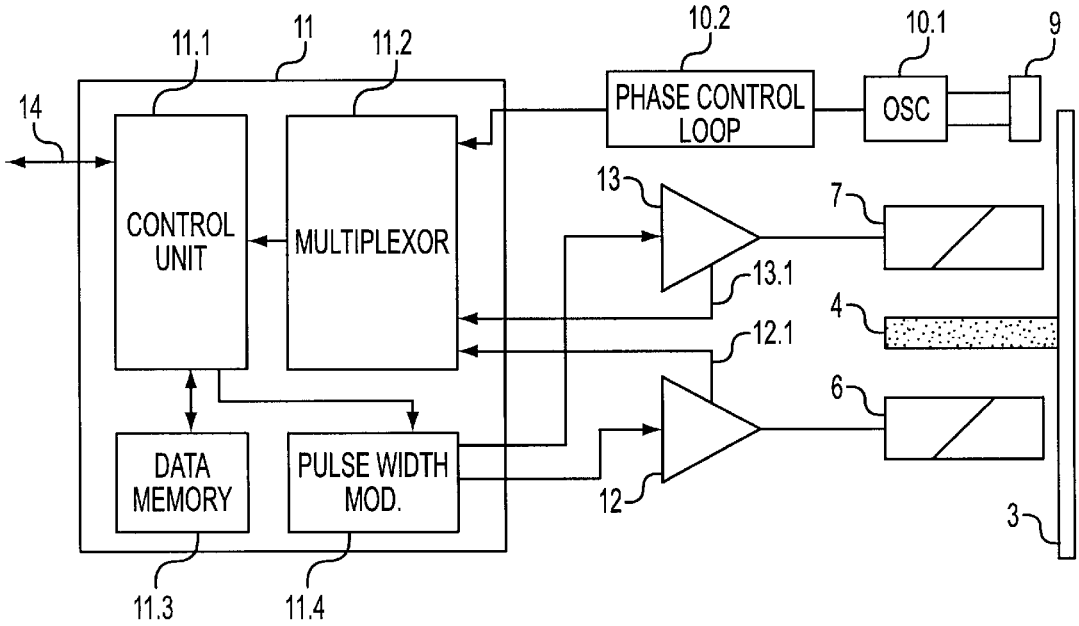
FIG. 3 is a block circuit description for an adjustment device according to the invention with a control and a regulating unit.

FIG. 3 shows a preferred control and regulating unit 11 according to the invention in the form of a diagram. The control and regulating unit 11 comprises a control unit 11.1, a multiplexer unit 11.2, a data memory 11.3 and a pulse-width modulation unit 11.4.

A measuring coil is used as position sensor 9. The position of armature 4 is determined indirectly by the depth to which connecting rod 3 plunges in the measuring coil in that the inductance of coil 9 is recorded. The coil 9 and a capacitance in the element 10.1 together form an oscillator, in particular one with standard damping reduction. In the element 10.2, the oscillating frequency of the oscillator is converted to a voltage or a current, in particular by a phase control loop. If the depth to which the connecting rod end plunges or extends in the coil 9 changes, the oscillator frequency is detuned, which leads to a change in the output signal from the element 10.2. The speed v can be determined simply from two closely following position measurements of armature 4 by using a time differentiation, particularly a time-discrete differentiation. element 10.2. The speed v can be determined simply from two closely following position measurements of armature 4 by using a time differentiation, particularly a time-discrete differentiation.

The output signal from element 10.2 is conducted to the multiplexer unit 11.2 of the control and regulating unit 11. The control unit 11.1 requests the data from the multiplexer unit 11.2. The control unit 11.1 additionally receives data from a nondepicted central control unit, which data travel via the data line 14 to the control and regulating unit 11. These data preferably contain information on the operational state of the internal combustion engine, as well as the desired control angles for the gas-reversing valves. The control unit 11.1 links the position and/or speed data and/or current data from the multiplexer unit 11.2 with the operating parameters and the data for the characteristic curves, stored in the data memory 11.3, and uses these data to form a control signal for the pulse-width modulation unit 11.4. This unit controls the end stages 12 and 13, which measure the current flowing through the electromagnets 6 and 7 and conduct it to the multiplexer unit 11.2.

The data line 14 advantageously can be used to transmit not only the operating parameters from the central control unit to the control and regulating unit 11, but also to transmit diagnostic data back to the central control unit. These diagnostic data preferably contain information on the availability of the adjustment device 1 or all other data known to the control and regulating unit 11. Thus, the control and regulating unit 11 advantageously can be used to support possibly existing control devices. The diagnostic data preferably contain information on possible malfunctions in the electromagnetic adjustment device 1 and/or status information, which can be processed by any existing central control unit. Thus, it is possible to shut down malfunctioning control units, for example, and/or store error messages in a memory and/or inform the user of the internal combustion engine of the malfunction.

The control and regulating method according to the invention for adjustment device 1 is based on the principle of trajectory control. The intent is to control the adjustment device 1 such that the movement of armature 4 follows a predetermined path/time characteristic curve. With this, the speed/time characteristic curve of armature 4 and thus also of the adjustment member 2 is fixed as well. For this, a characteristic curve or a group of characteristic curves are stored in a data memory 11.3, which link the position s of armature 4 to a desired speed v, in particular for different operating conditions of the internal combustion engine or the component influenced by the adjustment device 1.

A desired characteristic curve in the s–v plane provides the desired speed value v for each possible actual value of the armature position s. The deviation between the actual value and the desired value for the speed v, as well as the actual position s of the anmature 4 are transmitted to an automatic controller, in particular a three-position controller. If the deviation is negative, meaning if the speed of armature 4 is too low, the automatic controller output will increase the current for the coils of the respectively attracting electromagnet 6 or 7, so that the armature 4 is attracted with the aid of the additional, stronger magnetic field. With a positive deviation, the controller output causes a lowering of the current flowing though the coil of the attracting magnet and/or an increase in the current through the second electromagnet to decelerate the armature 4. Within the tolerance limits provided by a three-position controller, it is advantageous for the pre-control to remain unchanged, particularly the points in time for starting up and shutting down the current to the electromagnets 6, 7.

The use of a simple two-position controller is also possible for compensating possible deviations of armature 4 from a predetermined position/speed curve. The configuration is less involved and more cost-effective.

It is particularly advantageous if the control and regulating behavior of the adjustment device 1 is changed adaptively and, for essentially similar control deviations occurring over a longer period of time, to adapt the parameters to the control in order to minimize the control deviations. In particular, the control and regulating unit 11 records similar control deviations that occur frequently, and the control is adapted with the aid of correction characteristics in the data memory 11.3. Thus, it is possible to compensate longer-term changes in the operating conditions, in particular aging and/or wear of the participating components.

Regular, in particular automatic, calibration steps are advantageously performed to adapt the regulating and control behavior. If the armature 4 rests against a pole surface 6.1, 7.1 of one of the electromagnets 6, 7, then the control and regulating unit 11 adjusts the current flowing through the respective electromagnet 6, 7 to a level, which is sufficient to permanently hold the armature 4. The control unit 11.1 calibrates the path sensor 9 in the two end positions of armature 4, meaning where it rests against the pole surfaces 6.1, 7.1, since the position of armature 4 is well known in those locations and can be adjusted reproducibly. Thus, errors caused by temperature influences and/or changes can be eliminated easily and reliably.

For one particularly advantageous embodiment, the start-up and shutdown times of electromagnets 6, 7, the desired characteristic curves of the speed/position course of armature 4 and the desired characteristic curves of the current/position course in particular are stored in a digital form. It is useful to store in particular load ranges, speed ranges and/or temperature ranges, varied switching moments and/or desired characteristic curves for different operating conditions. The advantage is that the adjustment device can be controlled optimally for different operating conditions.

The fact that the oscillation of the armature/spring system from the idle position can be carried out automatically with a separate start-up mode by the control and regulating unit 11 is a particular advantage of the invention. Since the actual position of armature 4 is known according to the invention, the necessary energy can be introduced into the system at the optimum points in time. Thus, the armature 4 can be moved with high reliability and low energy expenditure to one of the two end positions on the pole surfaces 6.1, 7.1 of the two electromagnets 6, 7.

Figure 4:
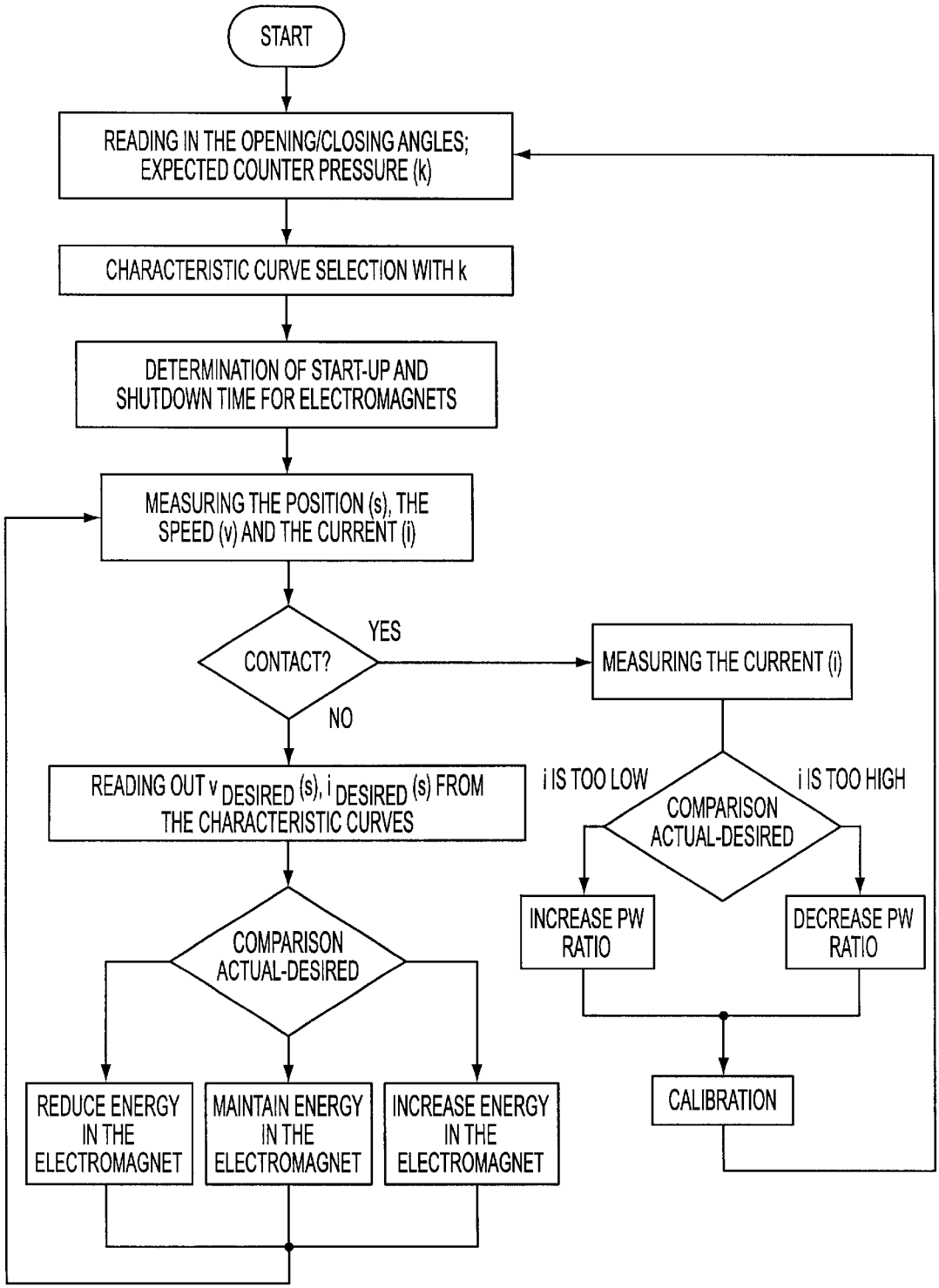
FIG. 4 is a flow diagram for a control and regulating method according to the invention.

FIG. 4 contains an operational chart for the preferred control and regulating method of a gas-reversing valve in an internal combustion engine. Initially, operating data for the component serviced by the adjustment device 1, in particular opening and closing angles of valve 2, are read into the control and regulating unit 11 via the data line 14. For this, data is transferred from a data memory or central control unit that may exist or any other available data source. In addition, information on counter forces to be expected is preferably transmitted as well, in particular the exhaust gas counter pressure. The amount for the counter forces to be expected is then used to select a characteristic curve from the data memory 11.3 of the control and regulating unit 11, which curve permits an operational sequence with the highest possible energy consumption and the lowest wear for armature 4.

The start-up and shutdown times for the electromagnets 6, 7 are determined from these data. In particular, this permits the start-up of electromagnets 6, 7 prior to the time of the actual movement of armature 4 in the direction of the respective magnet. The operational chart reaches a loop, which ends only when the armature 4 has reached the pole surface 6.1 or 7.1 of the attracting electromagnet 6 or 7. In the process, the position s, the speed v and the current i through the magnet are repeatedly measured.

As long as the position s of armature 4 does not correspond to a position where the armature makes contact with the pole surface, the selected characteristic curves in data memory 11.3 are read out and used for the desired course of the armature speed $V_{desied}(s)$ and the desired course of the current $i_{desied}(s)$.

The desired data and the actual data are compared and the energy in the electromagnet 6, 7 is subsequently reduced, increased, or kept the same. The loop is then repeated.

Once it is detected that the armature 4 has made contact with a pole surface 6.1 or 7.1, the sequence is continued in a current control loop. The current flowing through the holding electromagnet 6 or 7 is measured, it compared to a desired value and is correspondingly increased or reduced or maintained, depending on the preset values for the control. In the process, the pulse width in particular can be adapted by means of a pulse-width modulation. The contact position is preferably calibrated while the armature 4 makes contact with the pole surface.

Figure 5:
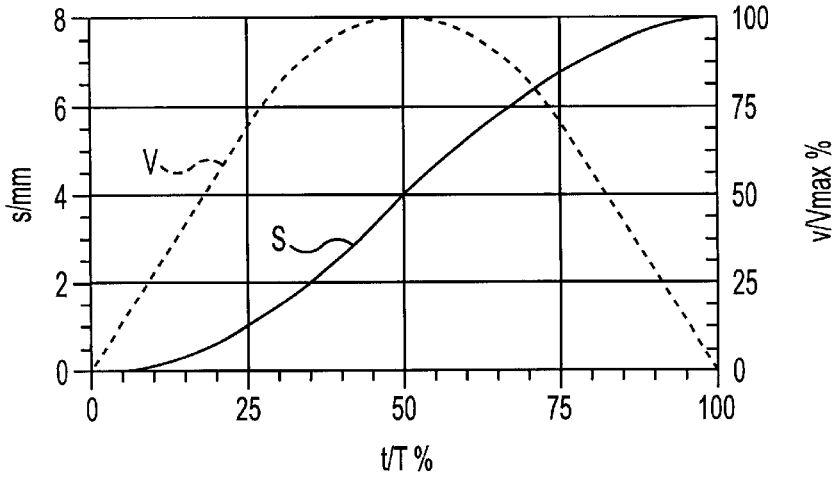
FIG. 5 is a time/path diagram for an adjustment device according to the invention.

FIG. 5 shows the characteristic curves for speed and path as a function of the time. The time axis is standardized. The minimum position corresponds to the first pole surface, the maximum position to the opposite-arranged pole surface of the two electromagnets. In the ideal case, meaning if the friction is not considered and the magnets ideally can be switched with equal speed, the oscillating armature/spring system takes a sine-shaped course for the position and speed of the armature over time. Since the friction cannot be neglected during the actual operation, the control and regulating unit 11 compensates for this by metering out additional energy to the electromagnets 6, 7 at the respectively optimum points in time. With this, the armature/spring system over time can strongly approach the ideal course for the position and speed.

Different characteristic curves must preferably be used for different operating conditions since it is not possible to compensate for the friction completely, owing to the system inertia and, in particular, the fact that the magnetic field in the electromagnet cannot be built up with optional speed. These characteristic curves represent the optimum course with respect to wear and energy consumption for the respective operational point.

With the adjustment device according to the invention and the control and regulating method according to the invention, it is possible to reduce the speed at which the armature 4 makes contact with the respective pole surfaces 6.1, 7.1 to a speed below 3 m/s, in particular to below 1 m/s. Thus, the operation of the adjustment device 1, in particular the continuous operation, is improved and the wear of the adjustment device is reduced.

What is claimed is:

1. A method for operating an electromagnetically actuatable adjustment device, including an adjustment member connected to a connecting rod having at least one armature that is attached crosswise to its longitudinal axis, with the armature being moved between opposing pole surfaces of two electromagnets arranged at a distance to each other in an axial direction, two resetting springs that are effective in the axial direction connected to the connecting rod so that the armature is held in a center position between the electromagnets while the electromagnets are not supplied with current, and a path sensor element for detecting the position of at least one of the adjustment member and the armature, with the path sensor element being a coil disposed in an oscillator circuit and whose inductance is changed through a position change of the adjustment member;

said method including: measuring the inductance of the coil by measuring the frequency of the oscillating circuit; and, based on the measured frequency, adjusting the current flow through the electromagnets such that at least one of the armature and the adjustment member move along a predetermined position/speed characteristic curve.

2. A method according to claim 1, further comprising determining the speed (v) of at least one of the adjustment member and the armature from the position (s) of the adjustment member, transmitting at least one of the position (s) and the speed (v) to a control and regulating unit, and forming an actuation signal for supplying current to the electromagnets in the control and regulating unit from the transmitted at least one of the position (s) and the speed (v), and providing current operating parameters from an external data source to the control and regulating unit in order to form the actuation signal, so that the adjustment member follows a predetermined position/speed characteristic curve.

3. A method according to claim 2, further comprising determining the speed (v) of at least one of the adjustment member and the armature in a processing unit, outside of the control and regulating unit.

4. A method according to claim 2, further comprising determining the speed (v) of the adjustment member or the armature in the control and regulating unit.

5. A method according to claim 1, further comprising adjusting the current flow through the electromagnets such that the speed at which the armature makes contact with the pole surface is less than 3 m/s.

6. A method according to claim 1, further comprising using the path sensor as a sensor for the point in time at which armature makes contact with one of the pole surfaces.

7. A method according to claim 1, wherein the adjustment member is a periodically operated valve for an internal combustion engine.

8. An electromagnetically actuatable adjustment device, comprising: an adjustment member; a connecting rod connected to the adjustment member and having at least one armature attached thereto and extending crosswise to a longitudinal axis of the connecting rod, with the armature being moveable between opposing pole surfaces of two electromagnets arranged at a distance from each other in an axial direction of the connecting rod; two resetting springs that are effective in the axial direction connected to the connecting rod so that the armature is held in a center position between the electromagnets when the electromagnets are not supplied with current; a path sensor element for detecting the position of at least one of the adjustment member and the armature, with the path sensor element being a coil whose inductance is changed through a position change of the adjustment member; and means for measuring the inductance of the coil and for adjusting the current flow through the electromagnets such that at least one of the armature and the adjustment member moves along a predetermined position/speed characteristic curve.

9. An adjustment device according to claim 8, wherein the path sensor element is arranged adjacent to the connecting rod end that is far removed from the adjustment member.

10. An adjustment device according to claim 8, wherein the path sensor element is arranged inside a region of at least one of said electromagnets that is essentially free of a magnetic field.

11. An adjustment device according to claim 8, wherein the path sensor element is arranged between the pole surfaces of the electromagnets.

12. An adjustment device according to claim 8 wherein the connecting rod end that is far removed from the adjustment member is provided with at least one of metal, magnetic material and ferrite material.

13. An adjustment device according to claim 8, wherein the coil has a helical or cylindrical shape.

14. An electromagnetically actuatable adjustment device according to claim 8, wherein the adjustment member is a periodically operated valve for an internal combustion engine.

15. An electromagnetically actuatable adjustment device as defined in claim 8 wherein the coil is a component of an oscillator circuit, and the means for measuring measures the frequency of the oscillator circuit as a measure of the inductance of the coil of the path sensor element.

16. An electromagnetically actuatable adjustment device, comprising: an adjustment member; a connecting rod connected to the adjustment member and having at least one armature attached thereto and extending crosswise to a longitudinal axis of the connecting rod, with the armature being moveable between opposing pole surfaces of two electromagnets arranged at a distance from each other in an axial direction of the connecting rod; two resetting springs that are effective in the axial direction connected to the connecting rod so that the armature is held in a center position between the electromagnets when the electromagnets are not supplied with current; a path sensor element for detecting the position of at least one of the adjustment member and the armature and producing a corresponding output signal, with the path sensor element being at least one of a capacitive sensor, an optical sensor, a magnetic sensor, a semiconductor sensor and a Hall sensor; and means responsive to the output signal of the path sensor element for adjusting the current flow through the electromagnets such that at least one of the armature and the adjustment member moves along a predetermined position/speed characteristic curve.

17. An electromagnetically actuatable adjustment device according to claim 16, wherein the adjustment member is a periodically operated valve for an internal combustion engine.

* * * * *